US005560588A

United States Patent [19]

Hilliard

[11] Patent Number: 5,560,588

[45] Date of Patent: Oct. 1, 1996

[54] SUPPORT FOR TEMPORARY GUARD RAILING

[76] Inventor: J. Hilton Hilliard, 16418 Learnington La., Houston, Tex. 77095

[21] Appl. No.: 390,984

[22] Filed: Feb. 21, 1995

[51] Int. Cl.[6] ..... E04F 11/18

[52] U.S. Cl. ..... 256/65; 256/DIG. 6; 256/59

[58] Field of Search ..... 256/65, 59, DIG. 6, 256/DIG. 5, 19

[56] References Cited

U.S. PATENT DOCUMENTS

| | | | |
|---|---|---|---|
| 4,605,204 | 8/1986 | Schmanski et al. | 256/19 |
| 4,958,807 | 9/1990 | Wylie | 256/59 X |
| 5,238,321 | 8/1993 | Jarjoura | 256/65 X |

FOREIGN PATENT DOCUMENTS

| | | | |
|---|---|---|---|
| 6-2403 | 1/1994 | Japan | 256/59 |
| 783449 | 11/1980 | U.S.S.R. | 256/59 |

*Primary Examiner*—Anthony Knight
*Attorney, Agent, or Firm*—Browning Bushman

[57] ABSTRACT

A support for temporary guard railing erected along the edges of open floors, balconies, stairs, and the like in a building under construction. The support comprises a base adapted to be removably attached to a floor surface of the building and support walls upstanding from the base and defining between them an upwardly opening socket for receipt of a post. At least one pair of parallel rail guide flanges are adjoined to the base and project laterally outwardly with respect to one of the support walls.

11 Claims, 2 Drawing Sheets

SUPPORT FOR TEMPORARY GUARD RAILING

BACKGROUND OF THE INVENTION

OSHA prescribes a number of safety measures which must be taken to protect workers while a building is under construction, and these may also serve to protect other persons, such as an owner or prospective purchaser who wishes to see the building while under construction. Among these are requirements for temporary guard railing to be erected along the edges of floor surfaces where there is no wall or other restraint, and from which there is a sufficient vertical drop to present a serious hazard should a person fall from the edge of the floor surface.

As used herein, "floor surface" will be loosely construed to include virtually any generally horizontal surface such as a floor, a balcony, a step of a stairway, or a landing of a stairway. Such a floor surface will be considered "open" if there is no wall, permanent guard railing, or other restraint along its edge. It should be understood that such open floor edges can occur along the outer periphery of, for example, a floor or balcony, and can also occur inwardly from the edge, e.g., if the floor has an opening for receipt of a skylight, attic hatch, or the like.

Undesirable amounts of time and materials may be used where the temporary guard railing is constructed in a conventional manner from wood mounted to the building under construction in a conventional manner. Additional time is spent in removing the temporary guard railing when it is no longer needed, and even if some of the materials from that temporary railing can be re-used, it is usually necessary to disassemble that material and reconstruct a guard rail from scratch when it is re-used. Additionally, the low guard rail or toe board often required near the floor surface can make it difficult and still more time consuming to move materials such as pieces of sheetrock into the area protected by the guard railing.

SUMMARY OF THE INVENTION

The present invention provides a support which eases the construction of such temporary guard railing, helps to insure the required strength and rigidity of the railing, and makes it easier for materials to be moved onto the floor bounded by the guard railing. Furthermore, the support, preferably along with a post connected thereto, can be readily removed and re-used. The support, whether in its initial use or re-use, obviates some of the more difficult and time consuming aspects of conventional rail construction techniques, and its re-usability is therefore particularly time and cost effective, and all the more so when the post connected thereto can also be re-used without disassembly from the support.

More specifically, the support comprises a base, e.g., a plate, adapted to be removably attached to a floor surface, and support walls upstanding from the base and defining therebetween an upwardly opening socket for receipt of a post. It can be appreciated that the construction of a guard rail requires the erection of a series of vertical posts to which the lateral railing, in turn, is connected. Such posts must be firmly secured to the floor surface and fairly rigid. OSHA requires that such posts must be capable of withstanding, without failure, 200 pounds of pressure applied within two (2") inches of the top of a forty-two (42") inch post in an outward or downward direction. Thus, in conventional construction methods, the post would have to be securely braced with respect to the floor surface, e.g., by a plurality of wooden struts.

By way of contrast, with the support of the present invention, the base of which can be quickly and easily secured in place and removed, as by wood screws passing through holes in the base and into the floor, firm connection and adequate bracing is achieved by the prefabricated support, which can be used over and over. Furthermore, once a post has been secured in the socket of such a support, it is usually possible to leave the two connected for joint re-use, thereby further enhancing the efficiency. When affixed to surfaces of materials other than wood, e.g., concrete, particle board, etc., other suitable fasteners are used to secure the base.

The support walls of the device are preferably four in number and arranged to define a rectangular cross section to the aforementioned socket. Even more preferably, these support walls are joined to one another to form an enclosure defining the socket. This enhances the rigidity with which the post is supported.

The support preferably also comprises at least one pair of parallel rail guide flanges adjoined to the base and projecting laterally outwardly with respect to one of the support walls. This defines a channel in which a toe board can be slidably received, and that toe board can be raised upwardly within the channel, or even removed from the channel, to allow large materials such as pieces of sheetrock to be easily passed over the edge of the floor. Then, the toe board can be just as easily replaced to continue its function of preventing building materials, debris, tools, etc. from falling over the edge of an open floor.

Preferably, these flanges are adjoined to the respective support wall, and additional such flanges are provided for the other support walls. This allows for low rails to be quickly and easily replaced in various directions with respect to the central post. Furthermore, if the flanges are directly joined to both the support walls and the base, they also serve as struts enhancing the strength and rigidity of the support walls. This in turn may make it possible, for example, to minimize the necessary thickness of the support walls. Additional bracing members may be provided interconnecting the outer ends of the flanges themselves and the base.

While the foregoing summary brings out certain objects, advantages and features of the present invention, others will be made apparent by the following detailed description, the drawings, and the claims.

DETAILED DESCRIPTION

Figure 1:
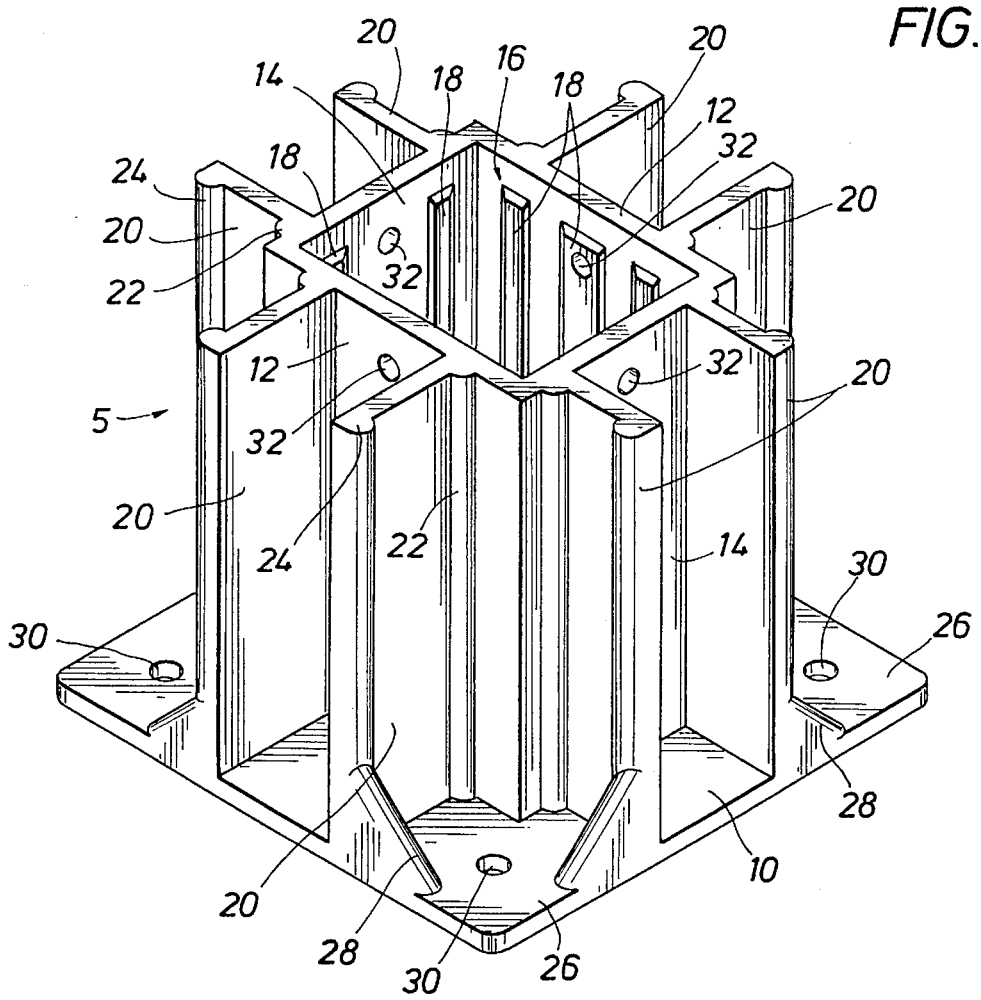
FIG. 1 is a perspective view of a support in accord with the present invention.
Figure 2:
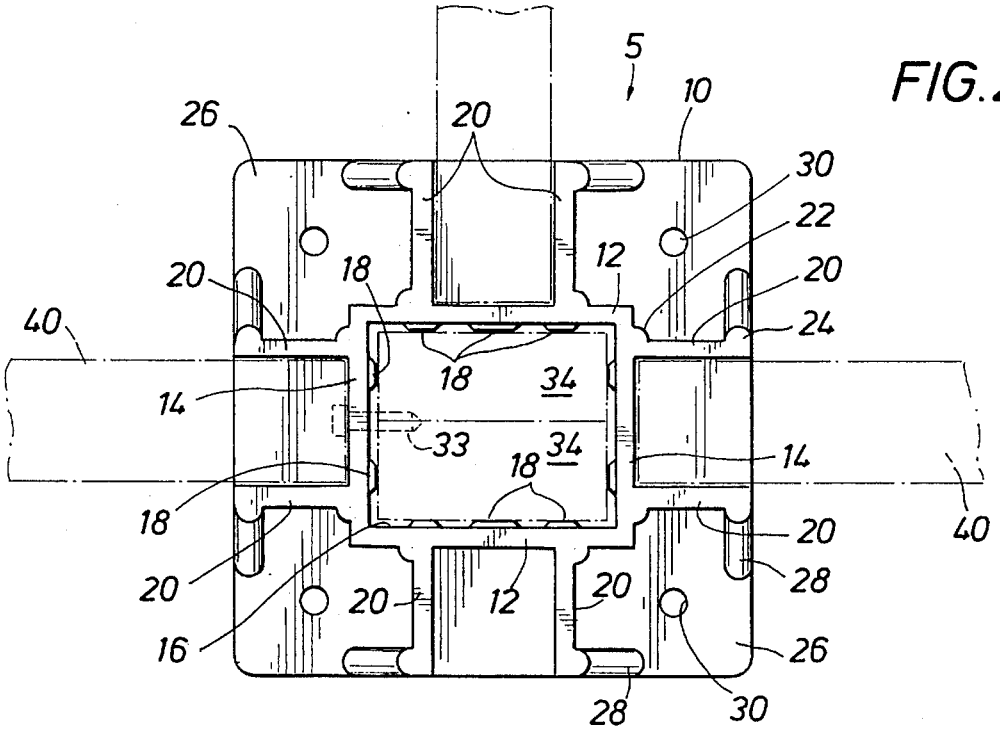
FIG. 2 is the top plan view of the device of FIG. 1 showing related portions of the guard railing in phantom.

Referring first to FIGS. 1 and 2, there is shown a support 5 according to the present invention. The support 5 comprises a base in the form of a rectangular plate 10. In normal use, this plate will be mounted flat against a generally horizontal floor surface, in a manner to be described more fully below. Terms such as "horizontal," "vertical," "upward," and the like are used herein with respect to such normal orientation in use, and not in a limiting sense.

The support 5 also comprises four support walls 12, 14, projecting upwardly from the base 10. The walls 12, 14 are arranged to define therebetween a socket 16 of generally rectangular cross-section, the longer walls 12 being parallel to and opposed to each other, and the shorter walls 14 also being parallel and opposed to each other, as well as perpendicular to the longer walls 12. While the walls 12, 14 could be discontinuous, e.g., could comprise a plurality of free standing flanges, it is highly preferable that they be directly adjoined to one another to form a complete enclosure defining the socket 16. This greatly enhances the strength of the walls defining the socket, thereby minimizing the wall thickness required, as well as the need for additional bracing. Indeed, in the embodiment shown, the entire support device is a continuous monolithic structure formed of a suitable hard plastic material.

Each of the walls 12 and 14 has a plurality of vertically elongated ribs 18 projecting laterally inwardly therefrom.

The rectangle defined by walls 12 and 14 is smaller than that defined by base 10, and is centrally located on the base 10. Projecting laterally outwardly from the outer side of each of the walls 12 and 14 is a respective pair of parallel rail guide flanges 20. Theoretically, these flanges could be only indirectly adjoined to the base 10 by directly adjoining the respective walls 12 or 14 and having their bottoms clearing the base 10; alternatively, they could directly adjoin the base 10 without meeting and directly adjoining the adjacent walls 12 or 14, while still being considered to project laterally outwardly with respect to those walls. However, it is highly preferred that they be directly adjoined to both the base 10 and their respective walls 12 or 14, as shown, and thus interconnect the base and the walls. Thereby, they not only serve as rail guides, in a manner to be described below, but also serve as bracing members or struts enhancing the rigidity of the walls 12 and 14.

Rigidity is further enhanced by beads 22 and 24 formed on the outer side of the each flange 20. Bead 22 runs vertically along the inner end of the flange 20, i.e., that end which adjoins the adjacent wall 12 or 14, and bead 24 runs along the outer or free end of the flange 20.

The flanges 20 preferably extend laterally outwardly from their walls 12 or 14 just to the outer edge of the base 10, as shown. Corner areas 26 of the base 10 are exposed between the flanges of perpendicular pairs of walls 12 and 14. Further support is provided by angled bracing members 28, each of which interconnects the lower outer edge of a respective flange 20, and more specifically its bead 24, to the base 10 in the adjacent corner area 26.

A hole 30 is provided in each of the corner areas 26, and a hole 32 is formed through each of the walls 12 and 14, near its upper end, and about midway between its lateral extremities.

The purpose of the socket 16 is to receive and support a wooden post, to which generally horizontally extending rails may be attached. The socket 16 is sized to hold a post comprised of two 2×4's 34 (see FIG. 2) attached together along their broader sides. Ribs 18 help to insure a snug fit, while also enhancing the ease with which the post may be inserted into the socket 16. After insertion, the post is connected to the walls 12 and 14 as by male connectors such as wood screws 33. Although it is possible, in some embodiments, to drill through the walls 12 and 14 to accommodate these screws, in the embodiment shown, the preformed holes 32 are sized to accommodate the desired size screw.

Next, the support 5, with the post secured therein, is placed in the desired position on the floor surface, and secured thereto by other male connectors, e.g., wood screws, inserted through holes 30 in the base 10 and into the floor.

Figure 3:
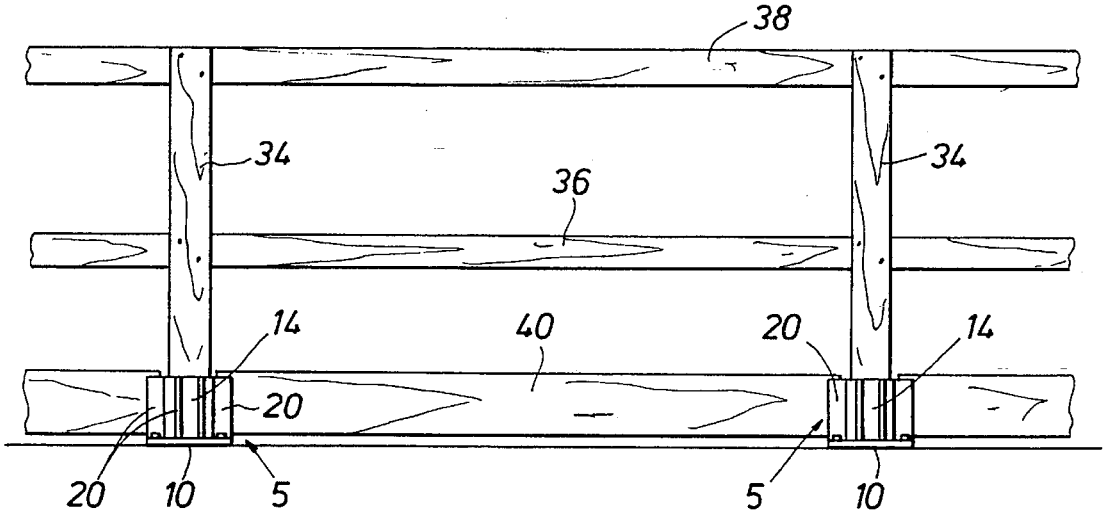
FIG. 3 is a side elevational view of a section of guard railing constructed using support members according to the present invention.

Referring now to FIG. 3 in conjunction with FIG. 2, once several of the supports 5 have been thus mounted on the floor, horizontal railings 36 and 38 may be nailed to adjacent posts 34 to interconnect them. In the typical embodiment shown in FIG. 3, there is an upper rail 38 interconnecting the tops of adjacent posts 34, and an intermediate level rail 36 interconnecting adjacent posts 34 approximately midway between their upper and lower ends.

In many circumstances, e.g., where there is a significant distance between adjacent posts 34, OSHA requires that toe boards 40 be provided. A toe board is a low railing, disposed closely adjacent the floor, which prevents building materials, debris, tools, etc., from falling over the open edge of the floor, The toe boards should be at least 3½" in height, and accordingly, 2×4's are typically used for the toe boards 40, and the channels formed by the respective pairs of flanges 20 are sized to slidably accommodate 2×4's. However, the flanges 20 are nearly six (6")inches high, and can therefore also accommodate two 2×4's, to effectively provide an eight (8") inch high toe board. This height is also suitable for the socket 16, i.e., to provide adequate rigidity for the post 34 without excessive wall thickness or extent of bracing.

In any case, the toe board 40 can be easily slid down into the facing channels formed between flanges 20 on adjacent ones of the supports 5. Because the toe boards 40 are retained by the flanges 20, they need not be fastened, either to the support device 5 or to the vertical post, as by nails or screws. Accordingly, they can be very easily raised up temporarily, e.g., to allow a large object such as a piece of sheetrock to be passed over the open edge of the floor for use in building a wall thereon. As soon as the material has been passed onto the floor, the toe board 40 can be lowered, to resume its safety function.

Figure 4:
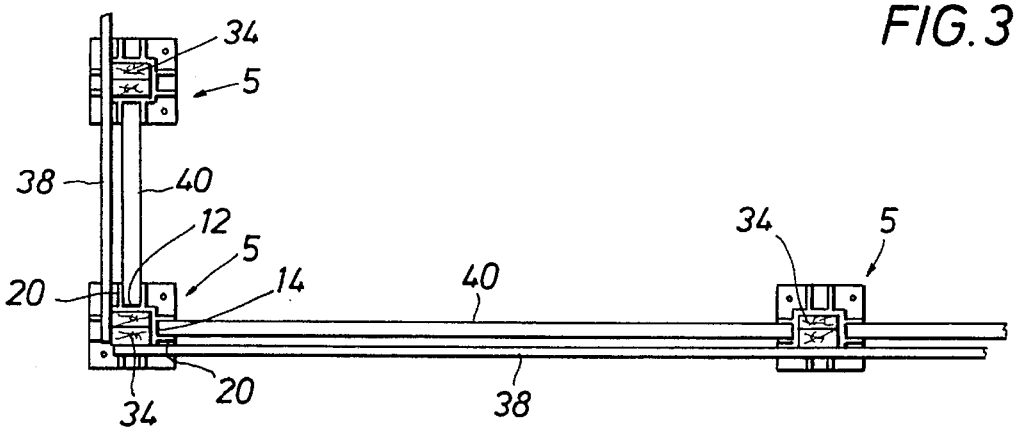
FIG. 4 is a top plan view of a structure similar to that of FIG. 3, but having a right-angled corner in the railing.

FIG. 4 is a top plan view showing how, due to the provision of flanges 20 on all four of the walls 12 and 14, railings with right-angled corners can be constructed.

Figure 5:
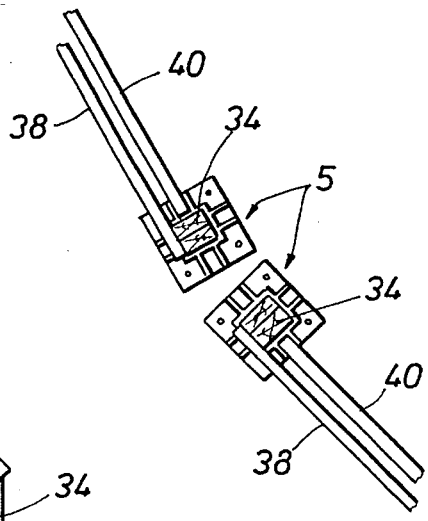
FIG. 5 is a view similar to that of FIG. 4 showing how a gradual curve at the edge of an open floor can be accommodated.

If the open edge of the floor to be protected has a gradual curve, this can be accommodated, as shown in FIG. 5, by placing those adjacent supports 5 which are angled with respect to each other in order to approximate the curve so close together that no interconnection therebetween is required.

Figure 6:
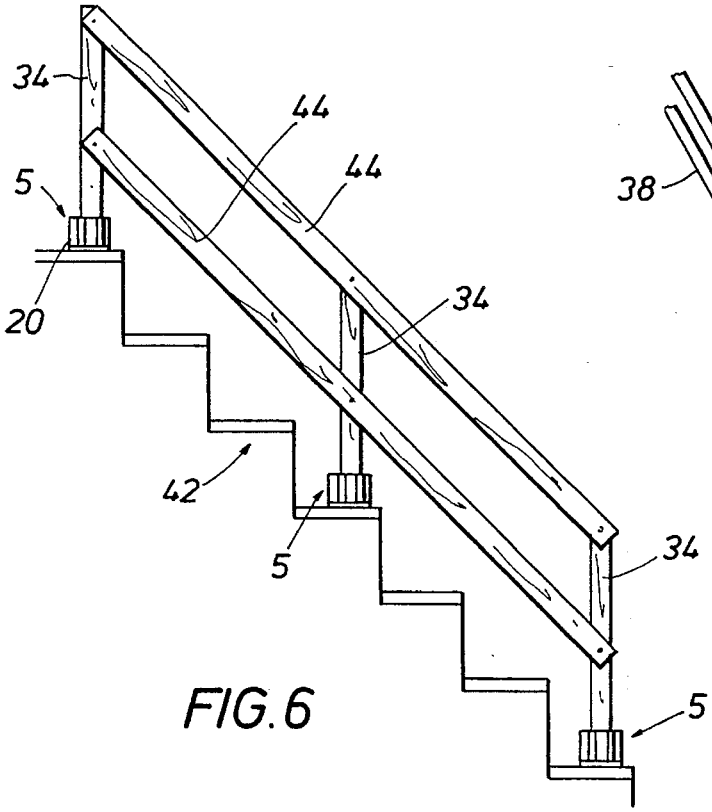
FIG. 6 is a side elevational view showing the use of supports according to the present invention in connection with temporary railing for a stairway.

FIG. 6 shows how support devices 5 according to the invention can be used to construct a temporary railing along an open or unenclosed edge of a stairway 42. At suitable intervals, e.g., every six feet, a support device 5 is secured to a step adjacent its outer edge posts 34 are premounted in the respective devices 5, as usual, and generally horizontal railings 44 are nailed to the posts 34, interconnecting them, but at an angle generally parallel to the steepness of the stairway 42. In this use, the flanges 20 are not used to mount toe boards, but they do perform their additional function as struts to brace the center socket for the posts 34.

Various modifications of the embodiments described above are within the skill of the art. By way of example only, the support device 5 could be formed of materials other than hard plastic, and could be formed in a non-monolithic, but integral, manner. The base 10 could be open at the bottom of socket 16 so that post 34 simply abuts the floor. Walls 12 and 14 and/or the corners at which they intersect could have slots, holes or the like to permit additional structural members to be attached to the lower part of post 34. Accordingly, it is intended that the scope of the present invention be limited only by the following claims.

I claim:

1. A support for temporary guard railing comprising: a base adapted to be removably attached to a floor surface;

support walls upstanding from the base and defining therebetween an upwardly opening socket for receipt of a post; and at least one pair of parallel rail guide flanges adjoining the base and projecting laterally outwardly with respect to one of the support walls, the guide rail flanges being of adequate dimension in both vertical and laterally projecting directions to maintain alignment of a toe board slidably received therebetween in both raised and lowered positions of said toe board with respect to said base.

2. The apparatus of claim 1 wherein there are four such support walls arranged to define a rectangular cross section to the socket.

3. The apparatus of claim 2 wherein the support walls are adjoined to form an enclosure defining the socket.

4. The apparatus of claim 3 wherein each of the support walls has a plurality of vertically elongated ribs projecting laterally inwardly therefrom.

5. The apparatus of claim 3 wherein the support walls have holes therethrough for receipt of male connectors to connect the walls to the post.

6. The apparatus of claim 3 wherein the rail guide flanges are directly adjoined to the one wall.

7. The apparatus of claim 6 further comprising a second such pair of parallel rail guide flanges directly adjoined to and so laterally projecting from a second of the support walls opposite the one support wall.

8. The apparatus of claim 7 comprising a respective such pair of parallel rail guide flanges directly adjoined to and so laterally projecting from each of the four support walls and also directly adjoined to the base.

9. The apparatus of claim 8 wherein the base is a plate having an upper surface exposed in corner areas between the rail guide flanges on perpendicular support walls;

and wherein the corner areas have holes therethrough for receipt of male connectors to so attach the base to the floor surface.

10. The apparatus of claim 9 further comprising respective bracing members interconnecting the outer side of each flange to the base in the adjacent corner area.

11. The apparatus of claim 10 wherein each bracing member is disposed adjacent the outer end of the respective flange.

* * * * *